US006888117B2

(12) United States Patent
Yang

(10) Patent No.: US 6,888,117 B2
(45) Date of Patent: May 3, 2005

(54) COMBINATION HOOD AND MICROWAVE OVEN

(75) Inventor: Ha-Yeong Yang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/689,551

(22) Filed: Oct. 21, 2003

(65) Prior Publication Data

US 2004/0155035 A1 Aug. 12, 2004

(30) Foreign Application Priority Data

Feb. 10, 2003 (KR) ..... 10-2003-0008175

(51) Int. Cl.[7] ..... H05B 6/74
(52) U.S. Cl. ..... 219/761; 219/757; 219/751
(58) Field of Search ..... 219/761, 757, 219/756, 709, 400, 716, 717, 751, 746, 754, 702, 762, 763; 126/21 A, 21 R, 285 B, 299 E, 299 D; 426/417, 425, 429; 454/56

(56) References Cited

U.S. PATENT DOCUMENTS 3,356,008 A * 12/1967 Simpson et al. ..... 126/299 D
4,143,646 A * 3/1979 Sampsel ..... 126/299 D
4,502,375 A * 3/1985 Hignite et al. ..... 454/56
6,291,809 B1 * 9/2001 Ha ..... 219/757
6,335,521 B1 * 1/2002 Jeong et al. ..... 219/757

OTHER PUBLICATIONS

Korean Patent Abstract for Publication No. 1997–11181, published Jul. 8, 1997.
Korean Patent Abstract for Publication No. 2002–27151, published Apr. 13, 2002.

* cited by examiner

*Primary Examiner*—Quang T. Van
(74) *Attorney, Agent, or Firm*—Staas & Halsey LLP

(57) ABSTRACT

A combination hood and microwave oven, in which the construction of a drive circuit relating to an exhaust device is simplified, reducing its manufacturing cost, and in which the number of user's manipulations required to operate the exhaust device is reduced, providing convenience of use to the user. The combination hood and microwave oven includes a variable suction hole whose suction area is variable, a variable suction hole motor allowing a suction area of the variable suction hole to vary, an exhaust motor allowing air sucked through the variable suction hole to be discharged outside the combination hood and microwave oven, an exhaust motor drive unit controlling a rotational speed of the exhaust motor, and a variable suction hole adjusting unit that controls the variable suction hole motor to allow a suction area of the variable suction hole to vary according to the rotational speed of the exhaust motor.

30 Claims, 5 Drawing Sheets

COMBINATION HOOD AND MICROWAVE OVEN

CROSS-REFERENCE TO RELATED APPLICATIONS

This application claims the benefit of Korean Application No. 2002-8175, filed Feb. 10, 2003, in the Korean Intellectual Property Office, the disclosure of which is incorporated herein by reference.

BACKGROUND OF THE INVENTION

1. Field of the Invention

The present invention relates, in general, to a microwave oven and, more particularly, to a combination hood and microwave oven, installed over a cooking apparatus, such as a cooktop, to suck and discharge odors and smoke generated during cooking using the cooking apparatus.

2. Description of the Related Art

Generally a combination hood and microwave oven is installed over a cooking apparatus, such as an electrical oven or a gas oven, and carries out general cooking functions of a microwave oven and sucks odors and smoke coming up from a cooking apparatus disposed thereunder and discharges them to the outside.

FIG. 1 is a view showing the construction and installation of a conventional combination hood and microwave oven. As shown in FIG. 1, in a body 102 of the combination hood and microwave oven, are a cooking cavity (not shown) in which food is cooked, and a machine room 110 in which various kinds of electrical parts are installed. In the lower portion, both side portions and upper portion of the cooking cavity and the machine room 110, is an exhaust channel 106 that sucks odors or smoke generated from a cooktop 104 disposed below the body 102. In the upper back portion of the body 102, an exhaust fan 108 is installed to forcibly discharge the odors or smoke sucked through the exhaust channel 106. In the inlet of the exhaust channel 106 positioned at the lower portion of the body 102, is a variable suction hole 106*a* whose suction area is varied by a slidable opening and closing member 112. The slidable opening and closing member 112 is operated by a variable suction hole motor (not shown).

In the conventional combination hood and microwave oven, a switch that turns an exhaust motor on or off, and another switch that controls the rotational speed of the exhaust motor are mounted. Additionally, a control switch that controls the suction area of the variable suction hole 106*a* is separately mounted in the microwave oven. A user individually manipulates the switches to turn on the exhaust motor, and then controls the rotational speed of the exhaust motor and controls the suction area of the variable suction hole 106*a* according to the rotational speed of the exhaust motor.

As described above, the exhaust function of the conventional combination hood and microwave oven having a plurality of switches is accompanied by a number of switch manipulations. Additionally, the conventional combination hood and microwave oven needs a complicated drive circuit that controls the on/off operation and rotational speed of the exhaust motor and the suction area of the variable suction hole, so that its manufacturing cost is high.

SUMMARY OF THE INVENTION

Accordingly, it is an aspect of the present invention to provide a combination hood and microwave oven, in which the construction of a drive circuit relating to an exhaust device is simplified, thereby reducing its manufacturing cost, and in which the number of user manipulations required to operate the exhaust device is reduced, thereby providing convenience of use to the user.

Additional aspects and advantages of the invention will be set forth in part in the description which follows and, in part, will be obvious from the description, or may be learned by practice of the invention.

The foregoing and/or other aspects of the present invention are achieved by providing a combination hood and microwave oven including a variable suction hole whose suction area is variable, a variable suction hole motor allowing a suction area of the variable suction hole to vary, an exhaust motor that discharges air sucked through the variable suction hole to outside the combination hood and microwave oven, an exhaust motor drive unit that controls a rotational speed of the exhaust motor, and a variable suction hole adjusting unit that controls the variable suction hole motor allowing a suction area of the variable suction hole to vary according to the rotational speed of the exhaust motor.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
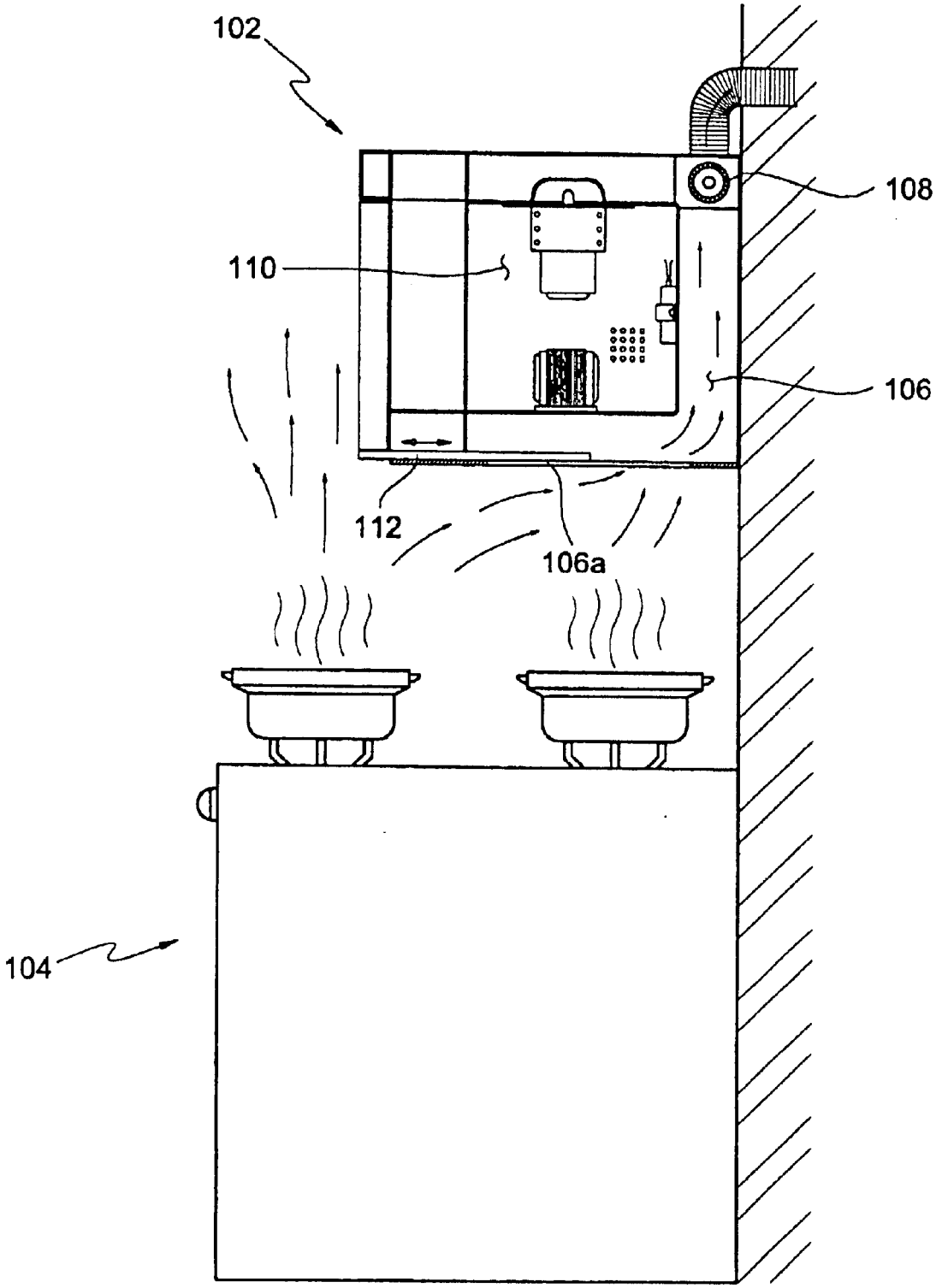
FIG. 1 is a view showing the construction and installation of a conventional combination hood and microwave oven.

Reference will now be made in detail to the preferred embodiments of the present invention, examples of which are illustrated in the accompanying drawings, wherein like reference numerals refer to like elements throughout.

Figure 2:
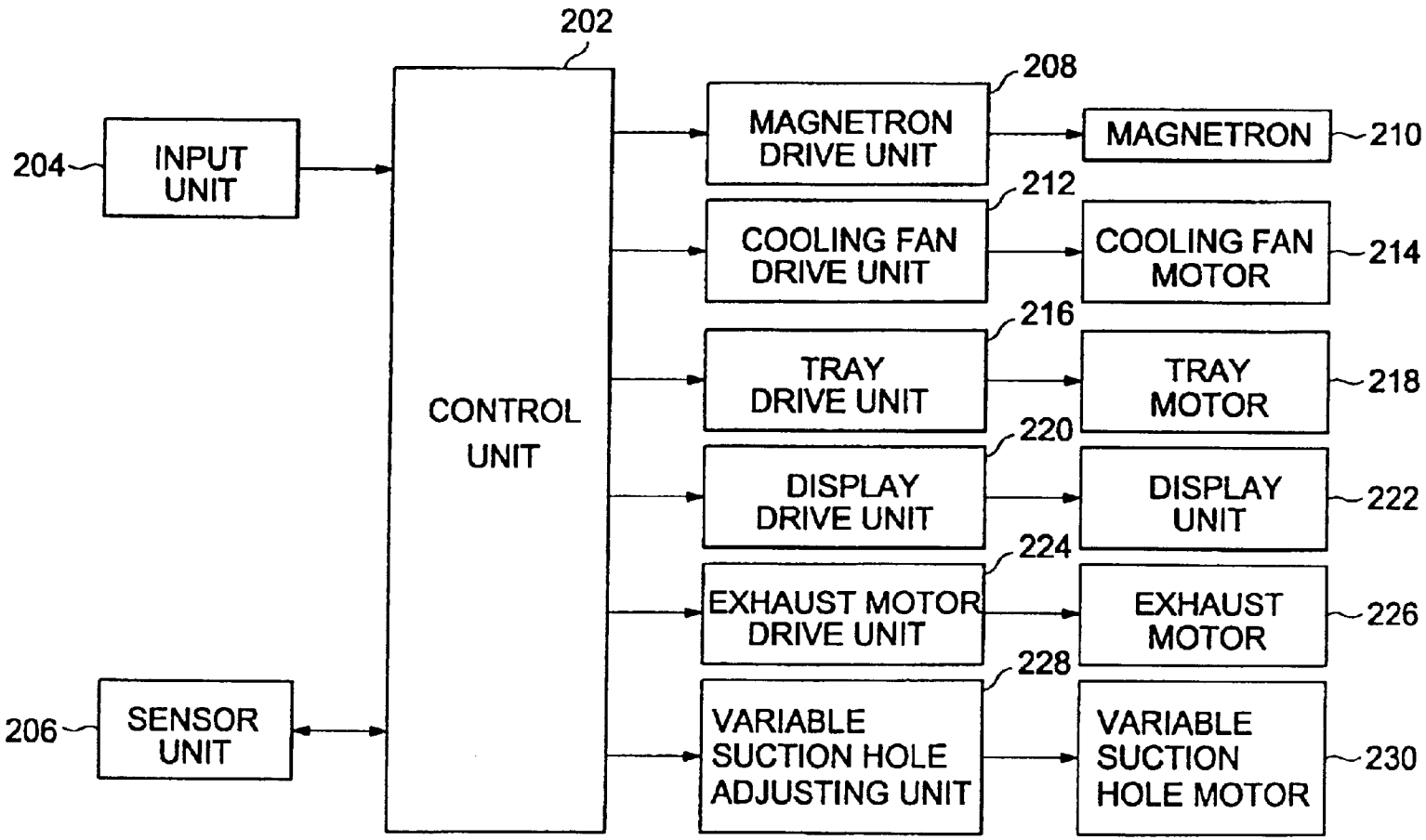
FIG. 2 is a block diagram showing the construction of a combination hood and microwave oven, according to an embodiment of the present invention.

FIG. 2 is a block diagram showing the construction of a combination hood and microwave oven, according to an embodiment of the present invention. As shown in FIG. 2, a control unit 202, controlling the overall operation of the microwave oven, is connected at its input terminals to an input unit 204 and a sensor unit 206. The input unit 204 is provided with a cooking mode set button that allows a user to set cooking modes, and numeral buttons that allow a user to set cooking time. The sensor unit 206 senses the cooking state in a cooking cavity. The control unit 202 is connected at its output terminals to a magnetron drive unit 208, a cooling fan drive unit 212, a tray drive unit 216, a display drive unit 220, an exhaust motor drive unit 224, and a variable suction hole adjusting unit 228. The magnetron drive unit 208 drives a magnetron 210 to generate microwaves. The cooling fan drive unit 212 drives a cooling fan motor 214 disposed in a machine room (not shown) of the microwave oven to prevent various kinds of electrical parts from being overheated. The tray drive unit 216 drives a tray motor 218 to rotate a tray (not shown) disposed in the cooking cavity. The display drive unit 220 drives a display unit 222 to display a help menu and cooking information of cooking modes, and set values. The exhaust motor drive unit 224 controls the on/off operation and rotational speed of an exhaust motor 226. The variable suction hole adjusting unit 228 controls the suction area of the variable suction hole 106*a* by changing the rotating direction of a variable suction hole motor 230 and therefore allowing the opening and closing member 112 to move forward or backward as shown in FIG. 1.

Figure 3:
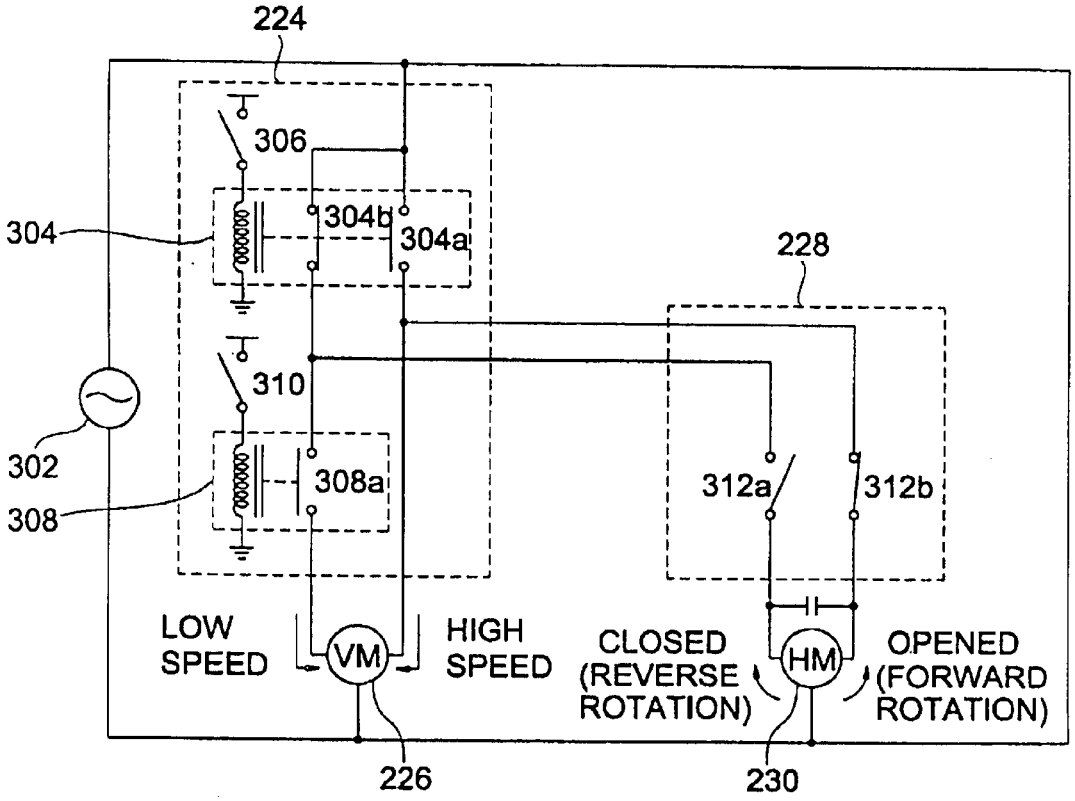
FIG. 3 is a view showing the construction of an exhaust motor drive unit and a variable suction hole adjusting unit of the combination hood and microwave oven of FIG. 2.

FIG. 3 is a view showing the construction of the exhaust motor drive unit 224 and the variable suction hole adjusting unit 228 of the combination hood and microwave oven shown in FIG. 2, according to the present invention. As shown in FIG. 3, the exhaust motor drive unit 224 controls the rotational speed of the exhaust motor 226 to be low or high according to the on/off operation of a first exhaust switch 306 and a second exhaust switch 310. In this case, the rotational speed of the exhaust motor 226 corresponds to exhaust capacity of the combination hood and microwave oven of the present invention.

A relay 304 provided in the exhaust motor drive unit 224 has normally open contact points 304*a* and normally closed contact points 304*b*. A normally open state indicates that, when the relay 304 is excited, open contact points are closed and then electrically connected to each other. In contrast, a normally closed state indicates that, when the relay 304 is excited, closed contact points 304*b* are opened and then electrically disconnected from each other. The normally open contact points 304*a* of the relay 304 are directly connected between a power supply 302 and the exhaust motor VM 226, while the normally closed contact points 304*b* are connected in series to normally open contact points 308*a* of another relay 308, and are connected between the power supply 302 and the exhaust motor VM 226.

The variable suction hole adjusting unit 228 is provided with two limit switches 312*a* and 312*b* that control the rotating direction of the variable suction hole motor HM 230. The limit switch 312*b* is turned on in the initial stage of operation of a hood, is connected in series to the normally open contact point 304*a* of the exhaust motor drive unit 224, and allows power to be supplied to the variable suction hole drive motor HM 230 when the normally open contact points 304*a* are closed. The variable suction hole motor HM 230 is rotated forward so that the variable suction hole is opened, when the normally open contact points 304*a* are closed and power is supplied. Thereafter, by being automatically turned off, the limit switch 312*b* allows the variable suction hole motor HM 230 to be stopped, when the variable suction hole is completely opened to a maximum hole size.

Another limit switch 312*a*, turned off in the initial stage of operation of the hood, is connected in series to the normally closed contact points 304*b* of the exhaust motor drive unit 224, and allows power to be supplied to the variable suction hole drive motor HM 230 when the normally closed contact points 304*a* are closed. The variable suction hole motor HM 230 is rotated in reverse so that the variable suction hole is closed, when the normally closed contact points 304*a* are closed and power is supplied. By being automatically turned off, the limit switch 312*a* enables the variable suction hole motor HM 230 to be stopped when the variable suction hole is partially closed to a predetermined hole size.

Therefore, since the limit switch 312*b* is already turned on when the exhaust motor VM 226 is rotated at a high speed, the variable suction hole motor HM 230 is rotated forward so that the variable suction hole is opened. In contrast, when the exhaust motor VM 226 is rotated at a low speed, the control unit 202 turns the limit switch 312*a* on so that the variable suction hole motor HM 230 is rotated in reverse, and allows the variable suction hole to be closed until the variable suction hole has a predetermined suction area. The control unit 202 examines the states of the normally open contact points 304*a* and 308*a* of the exhaust motor drive unit 224 to determine the rotational speed of the exhaust motor VM 226, or examines the rotational speed of the exhaust motor VM 226 by directly detecting the rotational speed of the exhaust motor VM 226 and comparing the detected rotational speed with a reference value.

Figure 4:
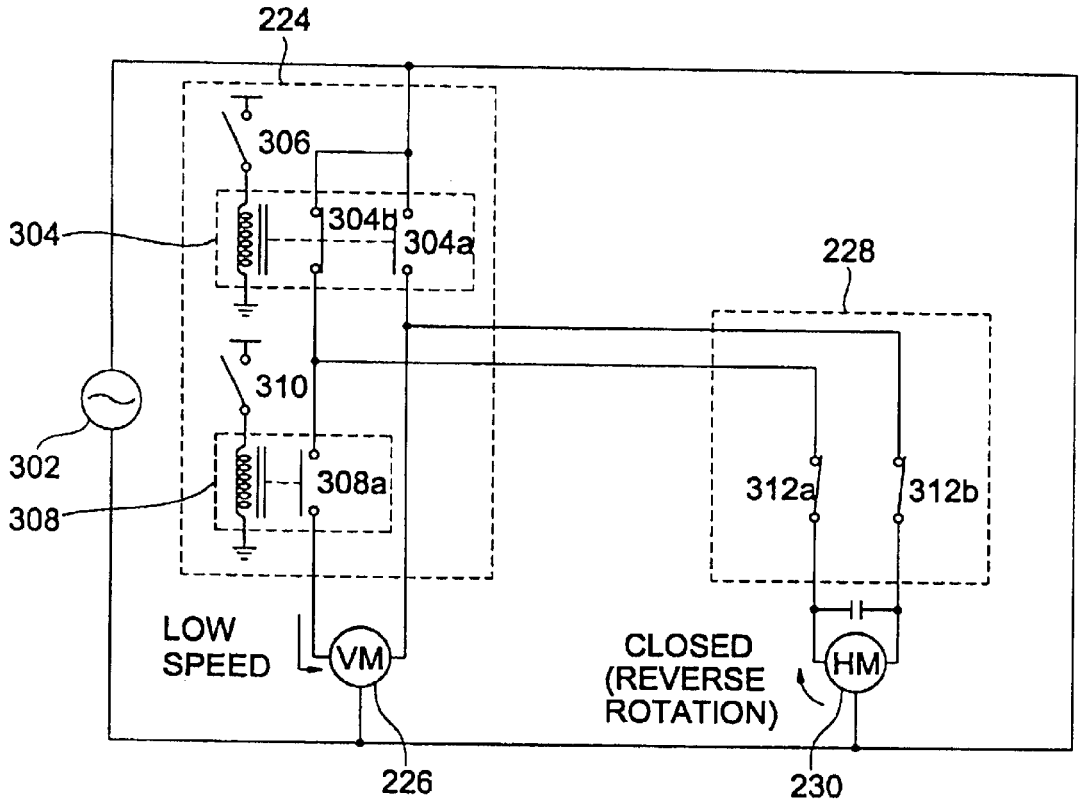
FIGS. 4 and 5 are views showing the operations of the exhaust motor drive unit and the variable suction hole adjusting unit of the combination hood and microwave oven of the present invention, respectively.

The detailed operations of the exhaust motor drive unit 224 and the variable suction hole adjusting unit 228 will be described with reference to FIGS. 4 and 5. FIG. 4 is a view showing the case where a user turns only a second exhaust switch 310 on. As shown in FIG. 4, if the second exhaust switch 310 is turned on by the user's manipulation while a first exhaust switch 306 of the exhaust motor drive unit 224 is turned off at the initial stage of operation of the hood, the relay 308 is excited and normally open contact points 308*a* are closed. Accordingly, power is supplied to the exhaust motor VM 226 through the normally open contact points 308*a* which are closed and the normally closed contact points 304*b* which are also closed, and thus the exhaust motor 226 is rotated at a low speed. Since two limit switches 312*a* and 312*b* of the variable suction hole adjusting unit 228 are turned on, but the normally open contact points 304*a* of the exhaust motor drive unit 224 are opened, power is supplied through only the limit switch 312*a* of the variable suction hole adjusting unit 228, so that the variable suction hole drive motor 230 is rotated in reverse and the variable suction hole is partially closed to a predetermined suction area.

Figure 5:
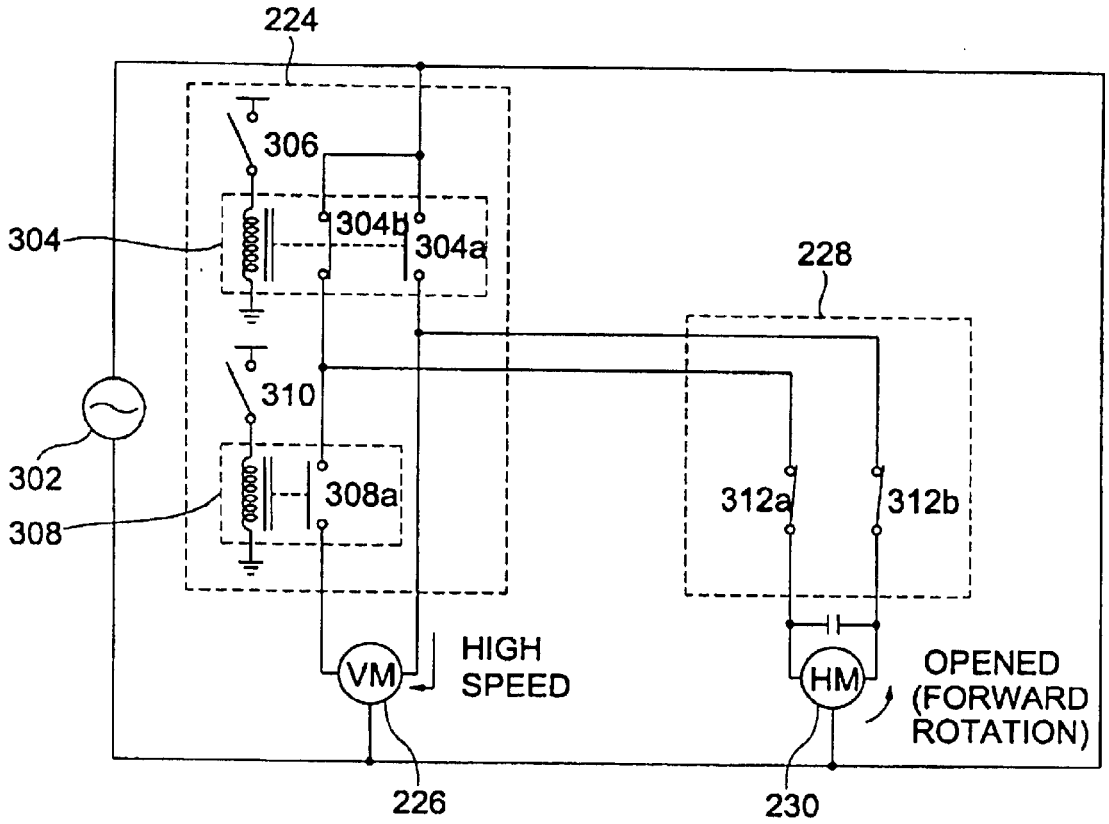

FIG. 5 is a view showing the case where a user turns the first exhaust switch 306 on while the second switch 310 is turned on. As shown in FIG. 5, if the first exhaust switch 306 is turned on by the user's manipulation while the second exhaust switch 310 is turned on, the relay 304 is excited and the normally closed contact points 304*b* are opened and the normally open contact points 304*a* are closed. Accordingly, power is supplied to the exhaust motor VM 226 through the normally open contact points 304*a* which are closed, thus the exhaust motor is rotated at a high speed. Further, power is supplied to the variable suction hole motor HM 230 through the normally open contact points 304*a* which are closed and the limit switch 312*b* which are previously turned on, so that the variable suction motor 230 is forwardly rotated so that the variable suction hole is opened.

As is apparent from the above description, the present invention provides a combination hood and microwave oven, in which a suction area is varied according to the rotational speed of the exhaust motor, thereby simplifying a drive circuit relating to an exhaust device and reducing the number of user's manipulations required to operate the exhaust device. Accordingly, the combination hood and microwave oven of the present invention may be manufactured at a lower cost and implemented to provide convenience of use.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A combination hood and microwave oven, comprising:

a variable suction hole;

a variable suction hole motor allowing a suction area of the variable suction hole to vary;

an exhaust motor discharging air sucked through the variable suction hole outside;

an exhaust motor drive unit controlling a rotational speed of the exhaust motor; and a variable suction hole adjusting unit controlling the variable suction hole motor according to the rotational speed of the exhaust motor.

2. The combination hood and microwave oven as set forth in claim 1, wherein:

the exhaust motor rotates at a lower rotational speed and at a higher rotational speed; and the variable suction hole motor increases the suction area of the variable suction hole when the exhaust motor rotates at the higher rotational speed, and decreases the suction area of the variable suction hole when the exhaust motor rotates at the lower rotational speed.

3. The combination hood and microwave oven as set forth in claim 1, wherein:

the variable suction hole motor maximally increases the suction area of the variable suction hole when the exhaust motor is rotated at a higher rotational speed; and the variable suction hole motor decreases the suction area of the variable suction hole to a predetermined size when the exhaust motor is rotated at a lower rotational speed.

4. The combination hood and microwave oven as set forth in claim 1, wherein the exhaust motor drive unit comprises:

a first exhaust switch allowing the exhaust motor to be rotated at the higher rotational speed; and a second exhaust switch allowing the exhaust motor to be rotated at the lower rotational speed.

5. The combination hood and microwave oven as set forth in claim 1, wherein the exhaust motor drive unit comprises:

a first relay having first normally closed contact points and first normally open contact points, and is excited by the first exhaust switch so that the first normally closed contact points open and the first normally open contact points close; and a second relay having second normally open contact points and is excited by the second exhaust switch so that the second normally open contact points close, wherein the first normally open contact points of the first relay are connected between a power supply terminal and the exhaust motor, and the first normally closed contact points of the first relay and the second normally open contact points of the second relay are connected in series between the power supply terminal and the exhaust motor, and are connected in parallel to the first normally open contact points of the first relay.

6. The combination hood and microwave oven as set forth in claim 5, wherein the variable suction hole adjusting unit comprises:

a first switch connected between the first normally closed contact points and a first terminal of the variable suction motor so that power provided through the first normally closed contact points of the exhaust motor drive unit is transmitted to the first terminal, and is turned on when the exhaust motor is rotated at a higher rotational speed; and a second switch connected between the first normally open contact points and a second terminal of the variable suction motor so that power provided through the first normally open contact points of the exhaust motor drive unit is transmitted to the second terminal, and is turned on when the exhaust motor is rotated at a lower rotational speed.

7. The combination hood and microwave oven as set forth in claim 6, wherein the first switch is a limit switch turned off at the time the suction area of the variable suction hole is decreased to have a predetermined size, and the second switch is a limit switch turned off at the time the suction area of the variable suction hole is increased to have a maximal size.

8. A combination hood and microwave oven, including an exhaust motor to be driven at a low and at a high rotational speed as well as a suction hole having a suction area of variable size, the hood and microwave oven comprising:

a suction hole adjusting unit increase or decrease the size of the suction area of the suction hole when the exhaust motor rotates at the high rotational speed or the low rotational speed, respectively.

9. The combination hood and microwave oven as set forth in claim 8, further comprising an exhaust motor drive unit coupled to the exhaust motor to control the rotational speed of the exhaust motor.

10. The combination hood and microwave oven as set forth in claim 9, further comprising a suction hole motor wherein the suction hole adjusting unit is coupled to the suction hole motor to increase or decrease the size of the suction area of the suction hole according to the rotational speed of the exhaust motor.

11. The combination hood and microwave oven as set forth in claim 10, wherein:

the suction hole motor maximally increases the suction area of the suction hole when the exhaust motor rotates at the high rotational speed; and the suction hole motor decreases the suction area of the suction hole to a predetermined size when the exhaust motor rotates at the low rotational speed.

12. The combination hood and microwave oven as set forth in claim 10, wherein the exhaust motor drive unit comprises:

a first exhaust switch that allows the exhaust motor to be rotated at the high rotational speed; and a second exhaust switch that allows the exhaust motor to be rotated at the low rotational speed.

13. The combination hood and microwave oven as set forth in claim 10, wherein the exhaust motor drive unit further comprises:

a first relay having first normally closed contact points between a power supply terminal and the exhaust motor and first normally open contacts points; and a second relay having second normally open contact points which are connected in series to the first normally closed contact points between the power supply terminal and the exhaust motor, and which are connected in parallel to the first normally open contact points, wherein when the first exhaust switch excites the first relay, the first normally closed contact points open and the first normally open contact points close, and when the second exhaust switch excites the second relay, the second normally open contact points close.

14. The combination hood and microwave oven as set forth in claim 13, wherein the suction hole adjusting unit comprises:

a first switch connected between the first normally closed contact points and a first terminal of the suction motor so that power provided through the first normally closed contact points of the exhaust motor drive unit is transmitted to the first terminal, and is turned on when the exhaust motor is rotated at the higher rotational speed; and a second switch connected between the first normally open contact points and a second terminal of the suction motor so that power provided through the first normally open contact points of the exhaust motor drive unit is transmitted to the second terminal, and is turned on when the exhaust motor is rotated at the lower rotational speed.

15. The combination hood and microwave oven as set forth in claim 14, wherein the first switch is a limit switch turned off at the time the suction area of the suction hole is decreased to have a predetermined size, and the second switch is a limit switch turned off at the time the suction area of the suction hole is increased to have a maximal size.

16. A combination hood and microwave oven, including a power supply, an exhaust motor, a variable suction hole having a variable suction area, and a variable suction hole drive motor, comprising:

a control unit controlling an operation of the microwave oven;

an exhaust motor drive unit, connected to the control unit, to control an on and off operation of the exhaust motor and to control a rotational speed of the exhaust motor; and a variable suction hole adjusting unit, connected to the control unit, to control the suction area of the variable suction hole by changing a rotating direction of the variable suction hole drive motor.

17. The combination hood and microwave oven according to claim 16, further comprising:

an input unit; and a sensor unit, wherein the control unit comprises terminals connected to the input unit and the sensor unit.

18. The combination hood and microwave oven according to claim 16, further comprising:

a magnetron drive unit to drive a magnetron to generate microwaves;

a cooling fan drive unit, including a cooling fan, to drive the cooling fan to prevent electrical parts from overheating;

a tray drive unit to rotate a tray; and a display drive unit to display a help menu and cooking information, wherein the control unit comprises output terminals connected to the magnetron drive unit, the cooling fan drive unit, the tray drive unit, the display drive unit, the exhaust motor drive unit, and the variable suction hole drive unit.

19. The combination hood and microwave oven according to claim 16, wherein the exhaust motor drive unit comprises:

a first exhaust switch; and a second exhaust switch, wherein the exhaust motor drive unit controls the rotating speed of the exhaust motor according to the on and off state of the first and second exhaust switches.

20. The combination hood and microwave oven according to claim 19, wherein the exhaust motor drive unit further comprises:

a first relay having normally open contact points and normally closed contact points; and a second relay having normally open contact points, wherein the normally open contact points of the first relay are connected between the power supply and the exhaust motor, and the normally closed contact points of the first relay are connected in series to the normally open contact points of the second relay and between the power supply and the exhaust motor, and when the normally open contact points are excited, the normally open contact points are shortened and become electrically connected, and when the normally closed contact points are excited, the normally closed contact points open and become electrically disconnected.

21. The combination hood and microwave oven according to claim 20, wherein the variable suction hole adjusting unit further comprises:

a first limit switch, mutually turned off and connected in series to the normally closed contact points of the first relay, to allow power to be supplied to the variable suction hole drive motor when the normally closed contact points of the first relay are close; and a second limit switch, mutually turned on and connected in series to the normally open contact points of the first relay, to allow power to be supplied to the variable suction hole drive motor when the normally open contact points are closed.

22. The combination hood and microwave oven according to claim 21, wherein when the normally open contact points of the first relay are closed, the exhaust motor is rotated at a high speed and power is supplied to the variable suction hole drive motor to rotate the variable suction hole drive motor forward, thereby opening the variable suction hole.

23. The combination hood and microwave oven according to claim 22, wherein, by being automatically turned off, the second limit switch allows the variable suction hole drive motor to be stopped.

24. The combination hood and microwave oven according to claim 23, wherein when the normally closed contact points of the first relay are closed, the exhaust motor is rotated at a low speed and power is supplied to the variable suction hole drive motor to rotate the variable suction hole drive motor in reverse, thereby closing the variable suction hole.

25. The combination hood and microwave oven according to claim 24, wherein, by being automatically turned off, the second limit switch allows the variable suction hole drive motor to be stopped.

26. The combination hood and microwave oven according to claim 25, wherein the control unit examines the states of the normally open contact points of the first and second relays of the exhaust motor drive unit to determine the rotational speed of the exhaust motor.

27. The combination hood and microwave oven according to claim 25, wherein the control unit examines the rotational speed of the exhaust motor by directly detecting the rotational speed of the exhaust motor and comparing the detected speed with a reference value.

28. A method to operate a combination hood and microwave oven, including an exhaust motor drive unit, to drive an exhaust motor, having first and second exhaust switches coupled to first and second relays, respectively, the first relay having normally open and normally closed contact points, and the second relay having normally open contact points, and a variable suction hole adjusting unit to rotate a variable suction hole drive motor in forward and reverse directions to open and close, respectively, a variable suction hole, comprising:

turning the second exhaust switch on while the first exhaust switch is turned off thereby exciting the first relay and closing the normally open contact points of the first relay;

supplying power to the exhaust motor, through the normally open contact points of the second relay, which are closed, and the normally closed contact points of the first relay which are closed, to rotate the exhaust motor at low speed; and supplying power to the variable suction hole adjusting unit to rotate the variable suction hole drive motor in reverse, thereby closing the variable suction hole.

29. A method to operate a combination hood and microwave oven, including an exhaust motor drive unit, to drive an exhaust motor, having first and second exhaust switches, coupled to first and second relays, respectively, the first relay having normally open and normally closed contact points, and the second relay having normally open contact points, and a variable suction hole adjusting unit to rotate a variable suction hole drive motor in forward and reverse directions to open and close, respectively, a variable suction hole, comprising:

turning the first exhaust switch on while the second exhaust switch is turned on thereby exciting the first relay and closing the normally open contact points of the first relay;

supplying power to the exhaust motor, through the normally open contact points of the first relay, which are closed; and supplying power to the variable suction hole adjusting unit to rotate the variable suction hole drive motor forward, thereby opening the variable suction hole.

30. A combination hood and microwave oven, including a power supply, an exhaust motor and a variable suction hole having a variable suction area, comprising:

a control unit controlling an operation of the microwave oven;

an exhaust motor drive unit, connected to the control unit, to control an on and off operation of the exhaust motor and to control a rotational speed of the exhaust motor; and a variable suction hole adjusting unit, connected to the control unit, to control the suction area of the variable suction hole according to the rotational speed of the exhaust motor.

* * * * *

UNITED STATES PATENT AND TRADEMARK OFFICE

CERTIFICATE OF CORRECTION

PATENT NO. : 6,888,117 B2
DATED : May 3, 2005
INVENTOR(S) : Ha-Yeong Yang

It is certified that error appears in the above-identified patent and that said Letters Patent is hereby corrected as shown below:

Column 6,
Line 22, after "unit" insert -- to --.

Signed and Sealed this

Tenth Day of January, 2006

JON W. DUDAS
*Director of the United States Patent and Trademark Office*